US007941896B2

(12) United States Patent
Park et al.

(10) Patent No.: US 7,941,896 B2
(45) Date of Patent: May 17, 2011

(54) UPRIGHT VACUUM CLEANER CAPABLE OF ADJUSTING HEIGHT OF SUCTION PORT ASSEMBLY

(75) Inventors: Chul-Woo Park, Gwangju (KR); Ji-Ho Seo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 236 days.

(21) Appl. No.: 12/254,693

(22) Filed: Oct. 20, 2008

(65) Prior Publication Data

US 2009/0255082 A1 Oct. 15, 2009

(30) Foreign Application Priority Data

Apr. 15, 2008 (KR) ..... 10-2008-0034723

(51) Int. Cl.
*A47L 5/34* (2006.01)
*A47L 5/00* (2006.01)
*A47L 9/00* (2006.01)

(52) U.S. Cl. ..... 15/361; 15/354; 15/333

(58) Field of Classification Search ..... 15/354–361, 15/333

See application file for complete search history.

(56) References Cited

U.S. PATENT DOCUMENTS

| | | | | |
|---|---|---|---|---|
| 3,579,699 | A * | 5/1971 | Balzer | 15/361 |
| 4,831,683 | A | 5/1989 | Kroll et al. | |
| 5,222,276 | A | 6/1993 | Glenn, III | |
| 5,269,042 | A | 12/1993 | Stephens et al. | |
| 6,081,963 | A * | 7/2000 | Jailor et al. | 15/368 |
| 6,256,833 | B1 * | 7/2001 | Steinberg | 15/325 |
| 6,286,181 | B1 | 9/2001 | Kasper et al. | |

FOREIGN PATENT DOCUMENTS

KR 10-2005-0063949 A 6/2005

* cited by examiner

*Primary Examiner* — Bryan R Muller
(74) *Attorney, Agent, or Firm* — Blank Rome LLP

(57) ABSTRACT

An upright vacuum cleaner has a cleaner body; a suction port assembly hinged to the cleaner body with a drum brush mounted on a front lower surface thereof; and a height adjusting apparatus set to an active mode or an inactive mode. In the active mode, the height adjusting apparatus raises the rear portion of the suction port assembly from an initial height, with the drum brush spaced from a surface, to bring the drum brush into contact with the surface when the cleaner body tilts from an upright position towards the rear of the suction port assembly. In the inactive mode, the rear portion of the suction port assembly remains at the initial height when the cleaner body tilts from the upright position towards the rear of the suction port assembly.

11 Claims, 10 Drawing Sheets

UPRIGHT VACUUM CLEANER CAPABLE OF ADJUSTING HEIGHT OF SUCTION PORT ASSEMBLY

REFERENCE TO RELATED APPLICATION

This application claims the benefit under 35 U.S.C. §119 of Korean Patent Application No. 10-2008-0034723, filed on Apr. 15, 2008, in the Korean Intellectual Property Office, the entire disclosure of which is incorporated herein by reference.

FIELD OF THE INVENTION

The present invention relates to a vacuum cleaner, and more particularly, to an upright vacuum cleaner in which the height of a suction port assembly may be adjusted according to a tilt of a body of the vacuum cleaner in order to bring a drum brush into contact with or remove the drum brush from a surface being cleaned.

BACKGROUND OF THE INVENTION

Upright vacuum cleaners generally include a cleaner body having a suction motor generating a suction source and a dust separating apparatus, and a suction brush body hinged at the bottom of the cleaner body.

A suction port assembly includes a drum brush on a lower surface thereof. A driving motor or a turbine pan rotates the drum brush to separate dust particles from a surface being cleaned. Accordingly, the dust particles are removed from the surface.

In a conventional upright vacuum cleaner, when a cleaner body is in an upright position, the suction port assembly is raised and the drum brush does not contact the surface being cleaned. By tilting the cleaner body, the drum brush contacts the surface being cleaned. If a user tilts the cleaner body to clean an uneven surface, such as a carpet, the drum brush may crush the uneven surface. In order to prevent this, the user must maintain the cleaner body in the upright position when cleaning an uneven surface.

The height of the suction port assembly of the conventional upright vacuum cleaner is capable of being adjusted. However, when the vacuum cleaner is in use, an operator cannot select between having the drum brush contact the surface being cleaned and removing the drum brush from the surface. In other words, the drum brush always contacts the surface being cleaned when the vacuum cleaner is in use.

SUMMARY OF THE INVENTION

Exemplary embodiments of the present invention address at least the above problems and/or disadvantages and other disadvantages not described above. However, the present invention is not required to overcome the disadvantages described above, and embodiments within the scope of the present invention may not overcome any of the problems described above.

According to the present invention, an upright vacuum cleaner comprises a cleaner body; a suction port assembly hinged to the cleaner body, and which includes a drum brush rotatably mounted on a front lower surface thereof, and a pair of main wheels, wherein at least one main wheel is disposed on each side of a rear portion of the suction port assembly; and a height adjusting apparatus configured to be in an active mode or an inactive mode and including an actuating portion; and a pair of supporters each having one end that supports the actuating portion and another end connected to a shaft of one of the main wheels of the suction port assembly. In the active mode, the height adjusting apparatus raises the rear portion of the suction port assembly from an initial height, in which the drum brush is spaced from a surface being cleaned, to bring the drum brush into contact with the surface when the cleaner body tilts from an upright position towards the rear of the suction port assembly, and the height adjusting apparatus lowers the rear portion of the suction port assembly to the initial height when the cleaner body returns to the upright position. In the inactive mode, the rear portion of the suction port assembly remains at the initial height when the cleaner body tilts from the upright position towards the rear of the suction port assembly. The suction port assembly may also include a partition wall which is connected to the shafts of the pair of main wheels.

The height adjusting apparatus may include an actuating portion; a lever hinged to the cleaner body; and a pair of supporters, each of which may be an idle roller. One end of each supporter supports the actuating portion and the other end of each supporter is connected to a shaft of one of the main wheels. The actuating portion may include an operating frame which is hinged to another portion of the lever, and is raised and lowered together with the lever; a pair of link bars, wherein each link bar is hinged to an end of the operating frame; and a pair of knobs, wherein each knob is hinged with a link bar and is slidably coupled with one of the pair of supporters. In the active mode the knobs are set to a first position in which ends of the knobs are aligned with the supporters, and in the inactive mode the knobs are set to a second position in which ends of the knobs extend past the supporters.

The pair of knobs may include a cylinder part, which may be formed in a perfect circle; and a cam part which is formed on one side of the cylinder part. The cam part may be formed in an oval shape, the center of the cam part may correspond to the center of the cylinder part, and the length of a minor axis of the cam part may be identical to the diameter of the cylinder part. The cam part may also protrude from a side of the periphery of the cylinder member to form a curve.

According to another exemplary aspect of the present invention, there is provided an upright vacuum cleaner, including a cleaner body which comprises a suction source and a dust separating apparatus; a suction port assembly which comprises a drum brush rotatably installed on a front lower surface thereof; and a height adjusting apparatus which selectively adjusts the height of the suction port assembly according to whether the cleaner body is in an upright or a tilted position.

BRIEF DESCRIPTION OF THE DRAWINGS

The above and/or other aspects of the present invention will be more apparent by describing certain exemplary embodiments of the present invention with reference to the accompanying drawings, in which.

DETAILED DESCRIPTION OF EXEMPLARY EMBODIMENTS OF THE INVENTION

Figure 1:
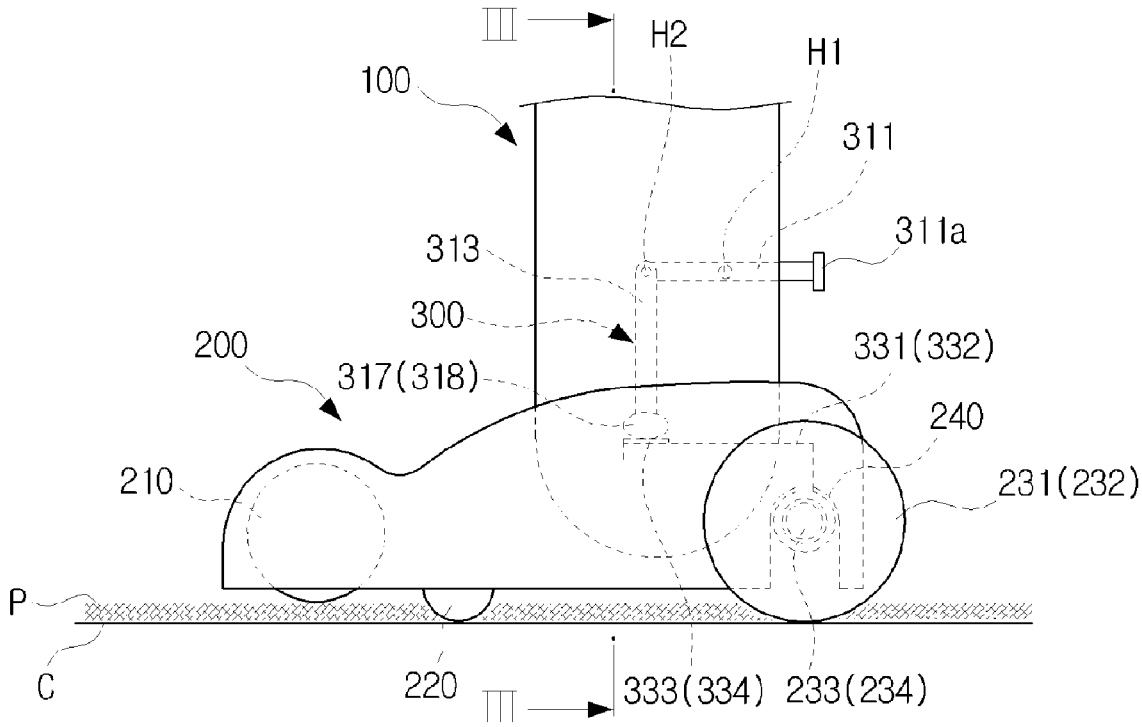
FIG. 1 is a side view illustrating an upright vacuum cleaner cleaning an uneven surface according to an exemplary embodiment of the present invention.

Certain exemplary embodiments of the present invention will now be described in greater detail with reference to the accompanying drawings.

In the following description, the same drawing reference numerals are used for the same elements in different drawings. The matters defined in the description, such as detailed construction and elements, are provided to assist in a comprehensive understanding of the invention. Thus, it is apparent that the present invention can be carried out without those specifically defined matters. Also, well-known functions or constructions are not described in detail since they would obscure the description of the invention with unnecessary detail.

FIG. 1 is a side view illustrating an upright vacuum cleaner in which the height of a suction port assembly may be adjusted according to an exemplary embodiment of the present invention, for cleaning an uneven surface, such as a carpet. Referring to FIG. 1, an upright vacuum cleaner may include a cleaner body 100, a suction port assembly 200, and a height adjusting apparatus 300.

The cleaner body 100 houses a suction motor (not shown) and a dust separating apparatus (not shown) to separate and collect dust from the air flowing into the cleaner body 100. The bottom end of the cleaner body 100 is connected to the suction port assembly 200 by a hinge (not shown). When the vacuum cleaner is not in use, the cleaner body 100 is set perpendicular to the suction port assembly 200. When the vacuum cleaner is in use, the cleaner body 100 is tilted, i.e., rotated, at a predetermined angle toward the rear of the suction port assembly 200.

The suction port assembly 200 may include a drum brush 210, which is rotatably mounted widthwise on a front lower surface of the suction port assembly 200, a pair of sub wheels 220 installed on a central lower surface of the suction port assembly 200, and main wheels 231, 232, wherein a main wheel is mounted on each side of the rear of the suction port assembly 200. A partition wall 240 may be formed integrally with the suction port assembly 200 along the width of the suction port assembly 200, and the partition wall 240 is mounted on the pair of main wheels 231, 232, by the weight of the cleaner body 100. Accordingly, the rear portion of the suction port assembly is configured to move up and down when the height adjusting apparatus is set to an active mode (described hereinbelow).

The height adjusting apparatus 300 may raise or lower the rear portion of the suction port assembly 200 according to the rotation of the cleaner body 100 so that the drum brush 210 contacts or is spaced from a surface being cleaned. The height adjusting apparatus 300 may include an actuating portion 310 fixedly mounted to the cleaner body 100, and a pair of supporters 331, 332 mounted on opposite sides of the suction port assembly 200.

Figure 2:
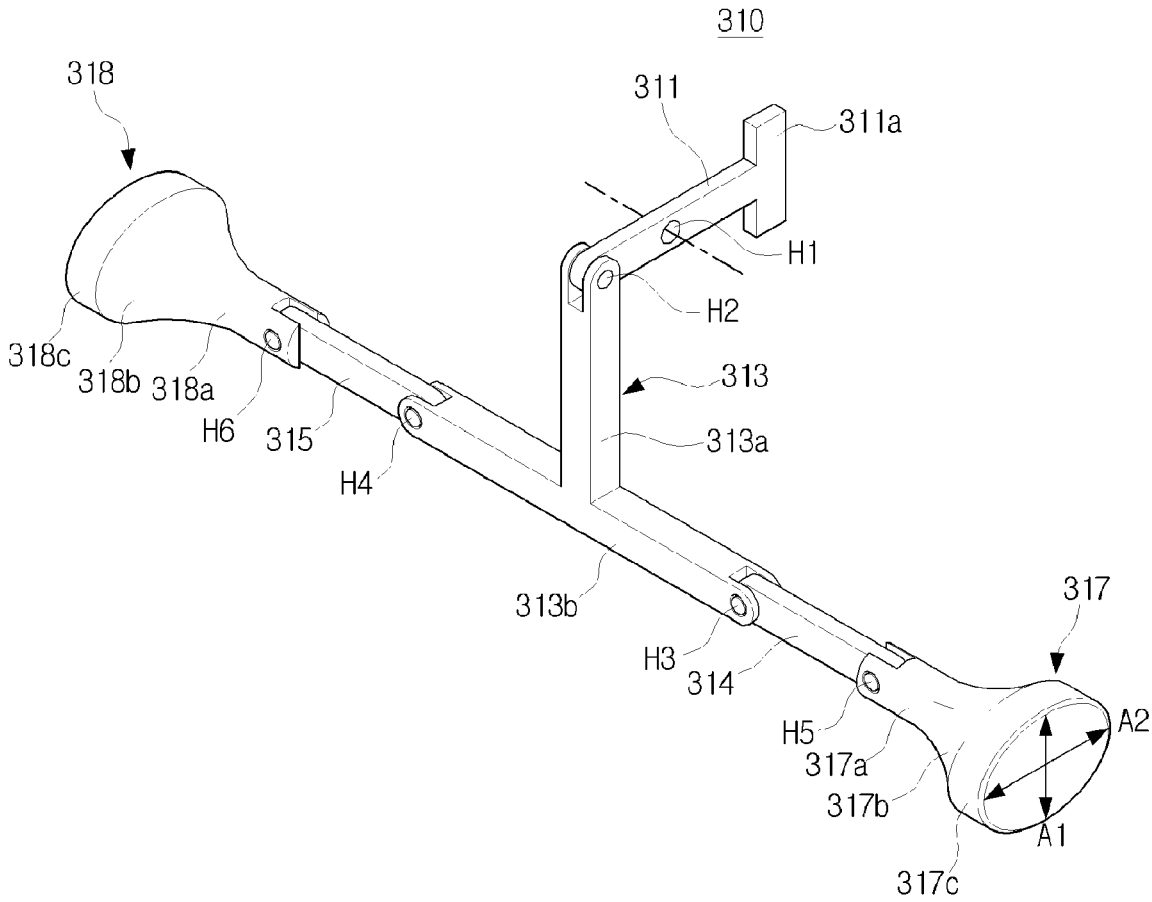
FIG. 2 is a perspective view illustrating an actuating portion set in an inactive mode to be mounted in a cleaner body according to an exemplary embodiment of the present invention.

Referring to FIG. 2, the actuating portion 310 may include a lever 311, an operating frame 313, a pair of link bars 314, 315, and a pair of knobs 317, 318. Points H1 to H6 marked on the actuating portion 310 each represent a hinge point.

A portion 311*a* of the lever 311 protrudes from the rear of the cleaner body 100, so as to be able to be manipulated by a user. A central position of the lever is hinged with a portion of the cleaner body 100 at point H1, and another portion of the lever is hinged with an upper portion of the operating frame 313 at point H2. The lever 311 operates about point H1 to raise and lower the operating frame 313.

The operating frame 313 may include a first member 313*a*, which is disposed vertically, and a second member 313*b*, which extends horizontally from a lower end of the first member 313*a*. The first member 313*a* and the second member 313*b* are formed substantially in a "⊥" shape. The operating frame 313 is raised and lowered in association with the operation of the lever 311 according to the position of the cleaner body 100.

One end of each of the link bars 314, 315 is hinged with an end of the second member 313*b* at points H3 and H4, respectively, to connect the operating member 313 and the pair of knobs 317, 318. The opposite end of each of the link bars 314, 315 is hinged with the knobs 317, 318, respectively, at points H5 and H6.

Figure 4:
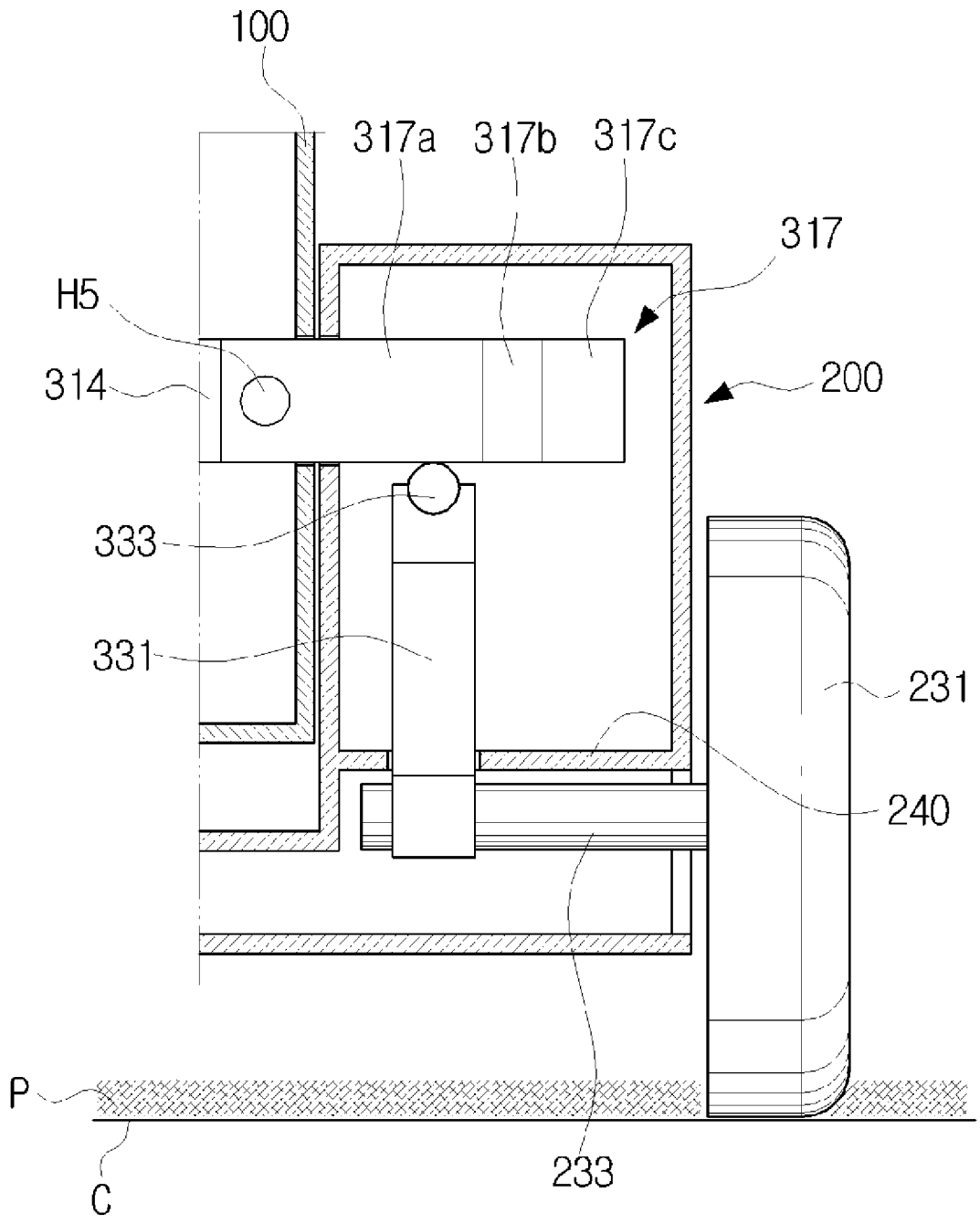
FIG. 4 is a partial cross-sectional view taken along line III-III of FIG. 1, in which an actuating portion is set to an inactive mode, and a cleaner body is in an upright position.

The pair of knobs 317, 318 are rotatable and penetrate opposite sides of the bottom of the cleaner body 100 and opposite sides of the rear of the suction port assembly 200. The positioning of knob 317 through the cleaner body 100 and the suction port assembly 200 is shown in FIG. 4. In doing so, when the height adjusting apparatus 300 is set to an active mode, the rear portion of the suction port assembly 200 is raised and lowered in association with the rotation of the cleaner body 100 and the pair of knobs 317, 318.

The pair of knobs 317, 318 may include cylinder members 317*a*, 318*a*, which may be formed in perfect circles, and cam members 317*c*, 318*c* which are formed on one side of the cylinder members 317*a*, 318*a*. Inclined planes 317*b*, 318*b* connect the cylinder members 317*a*, 318*a*, with the cam members 317*c*, 318*c*, in order to resolve differences in the height of the cylinder members 317*a*, 318*a* and the cam members 317*c*, 318*c*.

The cam members 317*c*, 318*c* may be formed in an oval shape, and the center of each of the cam members 317*c*, 318*c* corresponds to the center of the respective cylinder members 317*a*, 318*a*. The length of a minor axis A1 of the cam members 317*c*, 318*c* is identical to the diameter of the cylinder members 317*a*, 318*a*. The cam members 317*c*, 318*c* may protrude from opposite ends of the cylinder member 317*a* along a major axis A2 as shown in FIG. 2, and the suction port assembly 200 is raised and lowered as high as the length of the protruding part. This type of cam member is shown in FIG.

Figure 3A:
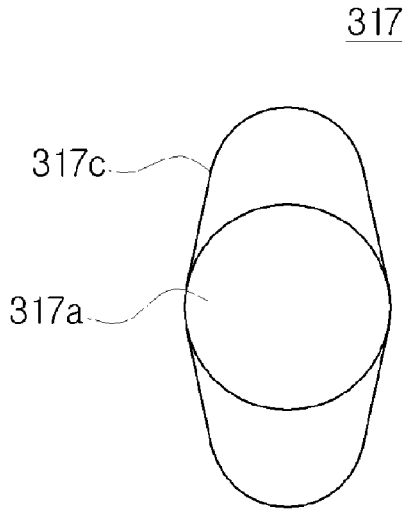
FIG. 3A is a sectional view illustrating a knob included in an actuating portion according to an exemplary embodiment of the present invention.
Figure 3B:
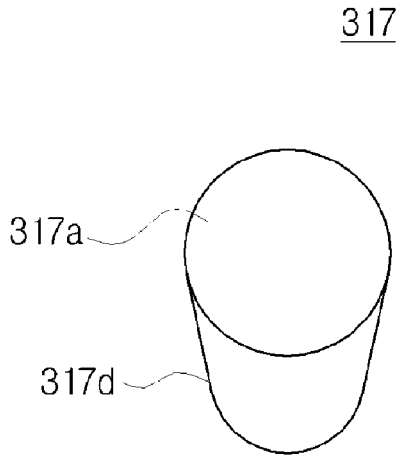
FIG. 3B is a sectional view illustrating a knob included in an actuating portion according to another exemplary embodiment of the present invention.

3A. The cam member may be formed such that a part of the cam member 317*d* protrudes from a side of the periphery of the cylinder member 317*a* to form a curve, as shown in FIG. 3B.

The lower ends of the pair of supporters 331, 332 are rotatably connected to shafts 233, 234 of the pair of main wheels 231, 232, respectively, and the upper ends of the pair of supporters 331, 332 are bent horizontally at the upper portion of the lower end. Idle rollers 333, 334 are disposed on the upper end of the pair of supporters 331, 332, and the pair of idle rollers 333, 334 may be placed perpendicular to the direction in which the pair of knobs 317, 318 move, so that the pair of knobs 317, 318 slide horizontally.

The pair of knobs 317, 318 slide into a first or second position on the pair of supporters 331, 332 according to the operation of the operating frame 313. When the lever 311 is lowered, the actuating portion 310 is set to an active mode and the pair of knobs 317, 318 are placed in the first position. In the first position, an end of each of the pair of knobs 317, 318 is aligned with the end of one of the supporters 331, 332 and the rear portion of the suction port assembly 200 is raised when the cleaner body 100 tilts towards the rear of the suction port assembly, and the drum brush 210 contacts the surface being cleaned. On the other hand, when the lever 311 is not lowered, the actuating portion 310 is set to an inactive mode and the pair of knobs 317, 318 are placed in the second position. In the second position, the end of each knob extends past the end of the supporters 331, 332 and the rear portion of the suction port assembly 200 is lowered, and the drum brush 210 remains spaced from the surface by a predetermined distance, when the cleaner body 100 tilts towards the rear of the suction port assembly.

Operation of the suction port assembly of the upright vacuum cleaner according to an exemplary embodiment of the present invention, which is in an active mode and an inactive mode, will be explained below.

Referring to FIGS. 1, 2, 4, and 5, a user sets the height adjusting apparatus 300 to an inactive mode when the user does not want the drum brush to contact the surface being cleaned, for example, an uneven surface such as a carpet C, so that the pile P of the carpet C is not crushed. When the height adjusting apparatus 300 is set to an inactive mode, the actuating portion 310 is in an inactive mode. More specifically, the lever 311 is horizontally disposed, and the second member 313*b* of the operating frame 313, the pair of link bars 314, 315, and the pair of knobs 317, 318 are arranged substantially in a straight line.

Figure 5:
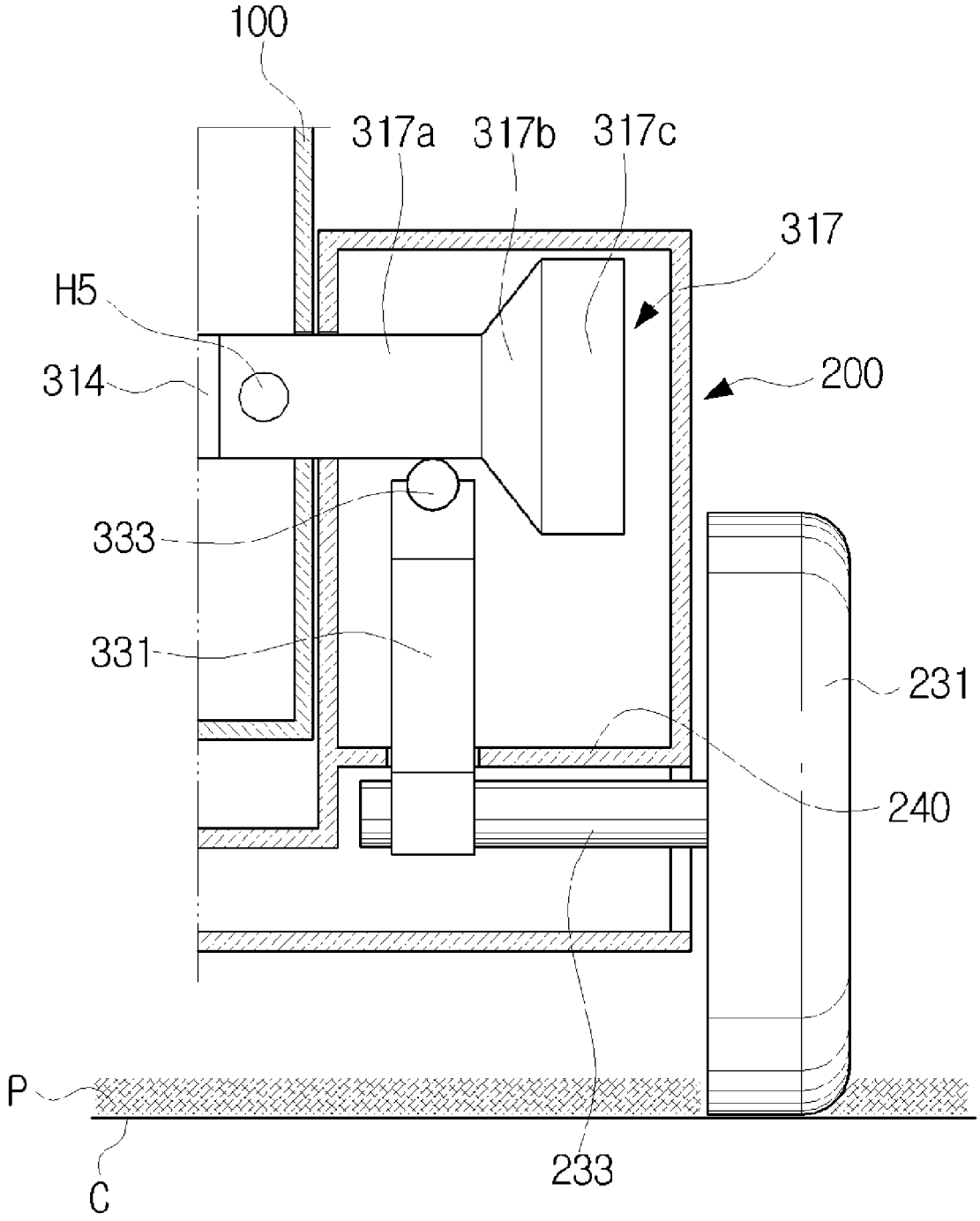
FIG. 5 is a partial cross-sectional view taken along line III-III of FIG. 1 according to an exemplary embodiment of the present invention, in which an actuating portion is set to an inactive mode, and a cleaner body is tilted.

Referring to FIG. 4, when the cleaner body 100 is set upright, and the height adjusting apparatus 300 is set to an inactive mode, the cylinder members 317*a* of the knob 317 are disposed at the second position on the idle roller 333 of the supporting portion 331. In this position, if the user tilts, i.e., rotates, the cleaner body 100 toward the rear portion of the suction port assembly 200 in order to clean the surface, as shown in FIG. 5, the parts protruding from both sides of the cam member 317*c* rotate to be vertically disposed, but the knob 317 remains in the second position, so that the rear portion of the suction port assembly 200 is not raised and the drum brush does not contact the surface being cleaned. Accordingly, when the height adjusting apparatus 300 is set in an inactive mode, the user need not be concerned that the drum brush 210 will crush the pile P of the carpet C.

When the user cleans an even surface, such as a wooden floor F, which the drum brush 210 does not crush, the user may set the height adjusting apparatus 300 to an active mode so that the drum brush 210 is positioned in contact with the floor F. The active mode of the height adjusting apparatus 300 will be explained with reference to FIGS. 6 to 9.

Figure 6:
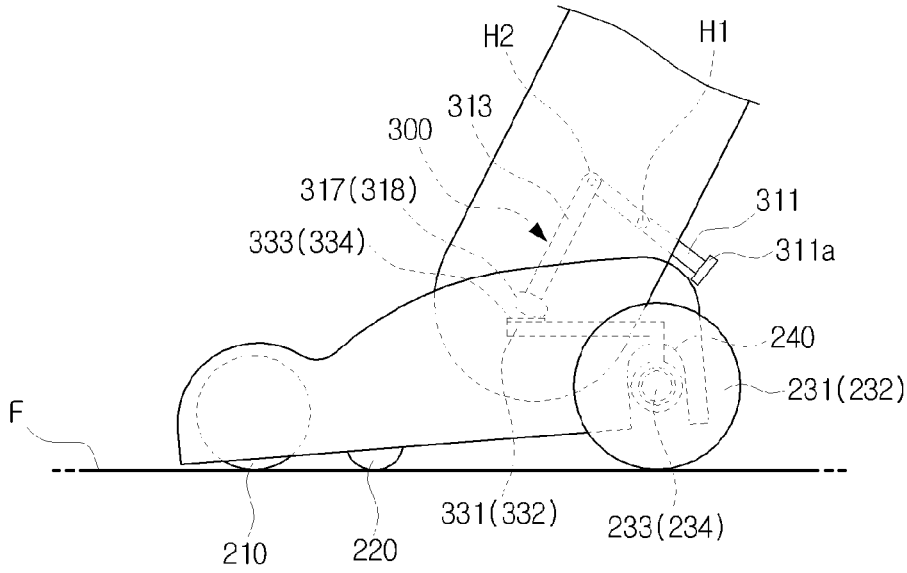
FIG. 6 is a side view illustrating an upright vacuum cleaner, in which an actuating portion is set to an active mode, cleaning an even surface.
Figure 7:
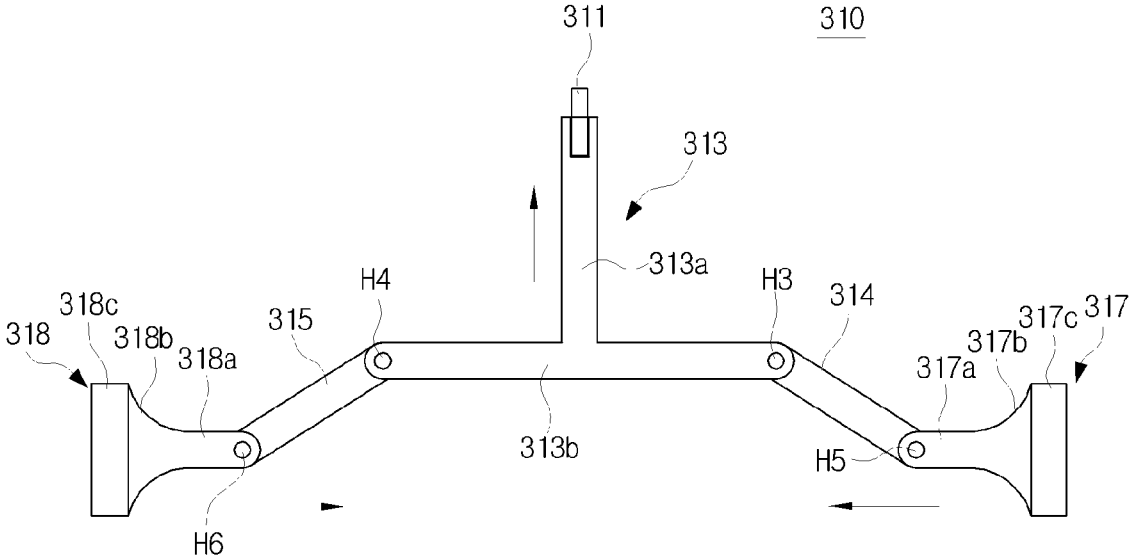
FIG. 7 is a front perspective view illustrating the actuating portion of FIG. 2 set to an active mode.

If a user presses a portion 311*a* of the lever 311 downward to set the height adjusting apparatus 300 to the active mode, as shown in FIG. 6, the opposite portion of the lever 311 rotates upwards around point H1. The operating frame 313 is raised vertically along the cleaner body 100, and pulls the pair of link bars 314, 315.

Figure 8:
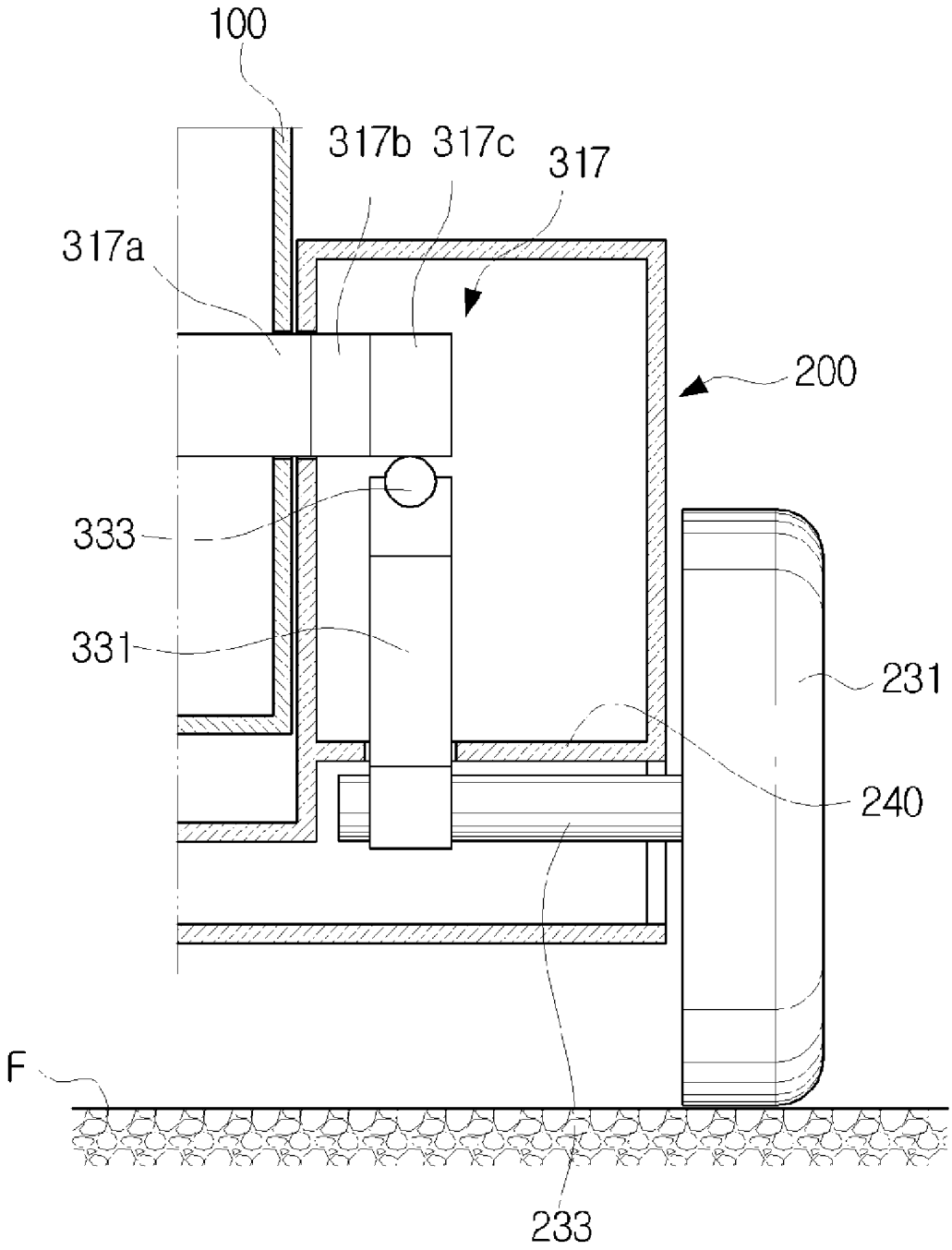
FIG. 8 is a partial cross-sectional view taken along line III-III of FIG. 1, in which an actuating portion is set to an active mode, and a cleaner body is in an upright position.

The pair of knobs 317, 318 are set to the first position by sliding toward the inside of the cleaner body 100 along the idle rollers 333, 334 so as to be perpendicular to the cleaner body 100. When the cleaner body 100 is upright and the pair of knobs 317, 318 are set to the first position, the protruding part of the cam member 317*c* is positioned horizontally, as shown in FIG. 8, and thus the rear portion of the suction port assembly 200 is not raised.

Figure 9:
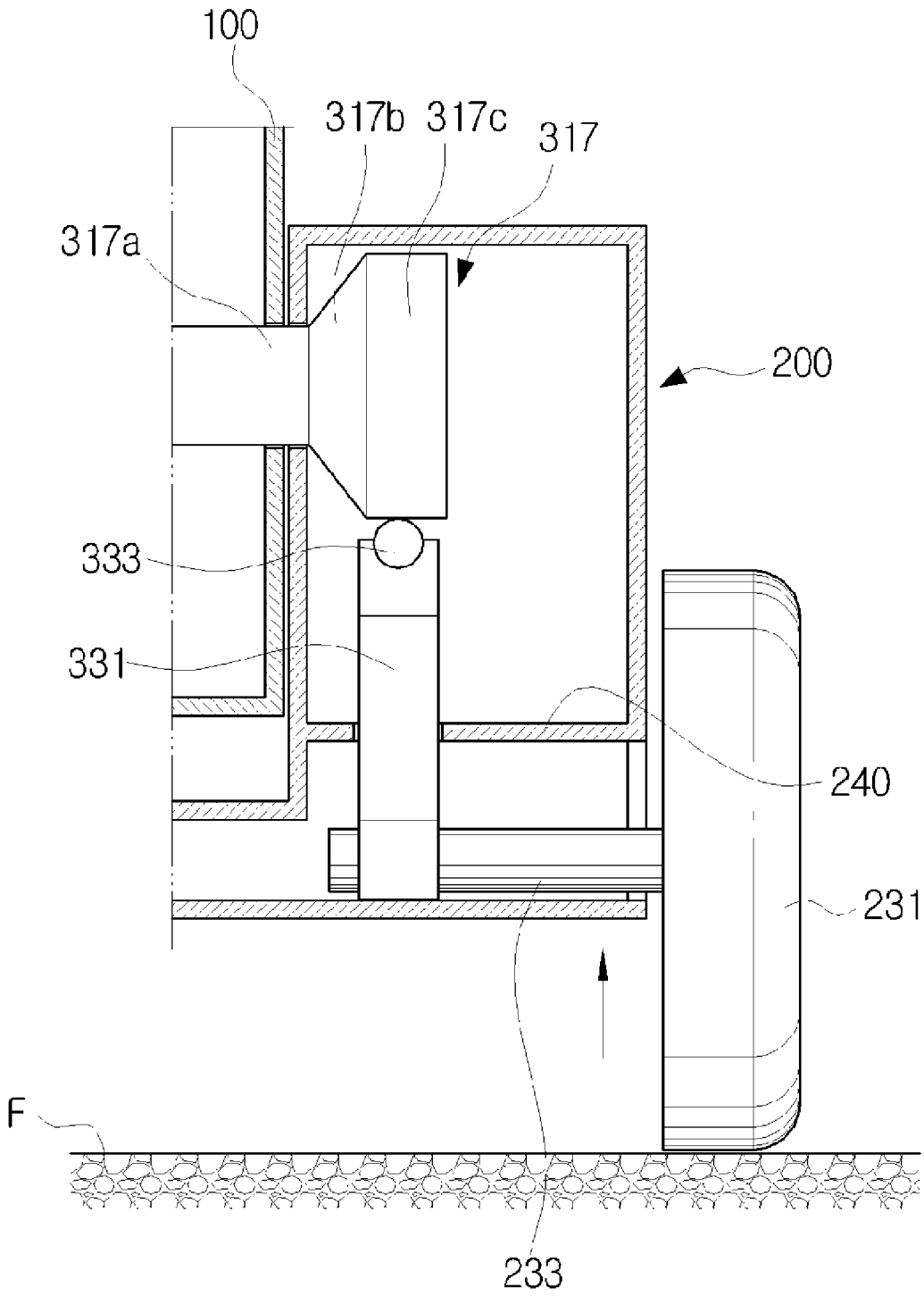
FIG. 9 is a partial cross-sectional view taken along line III-III of FIG. 1, in which an actuating portion is set to an active mode, and a cleaner body is tilted.

If a user tilts the cleaner body 100 toward the rear portion, as shown in FIG. 6, the protruding part of the cam member 317C rotates vertically, as shown in FIG. 9, and the rear portion of the suction port assembly 200 is raised together with the pair of knobs 317, 318. The front portion of the suction port assembly 200 is lowered along the sub wheel 220, and the drum brush 210 rotates while contacting the floor F, so the dust particles on the floor F are efficiently removed.

When the user raises the portion 311*a* of the lever 311 to change the height adjusting apparatus 300 of the vacuum cleaner from the active mode to the inactive mode, the operating frame 313 is lowered, the pair of knobs 317, 318 are converted from the first position to the second position, and the rear portion of the suction port assembly 200 is lowered.

Figure 10:
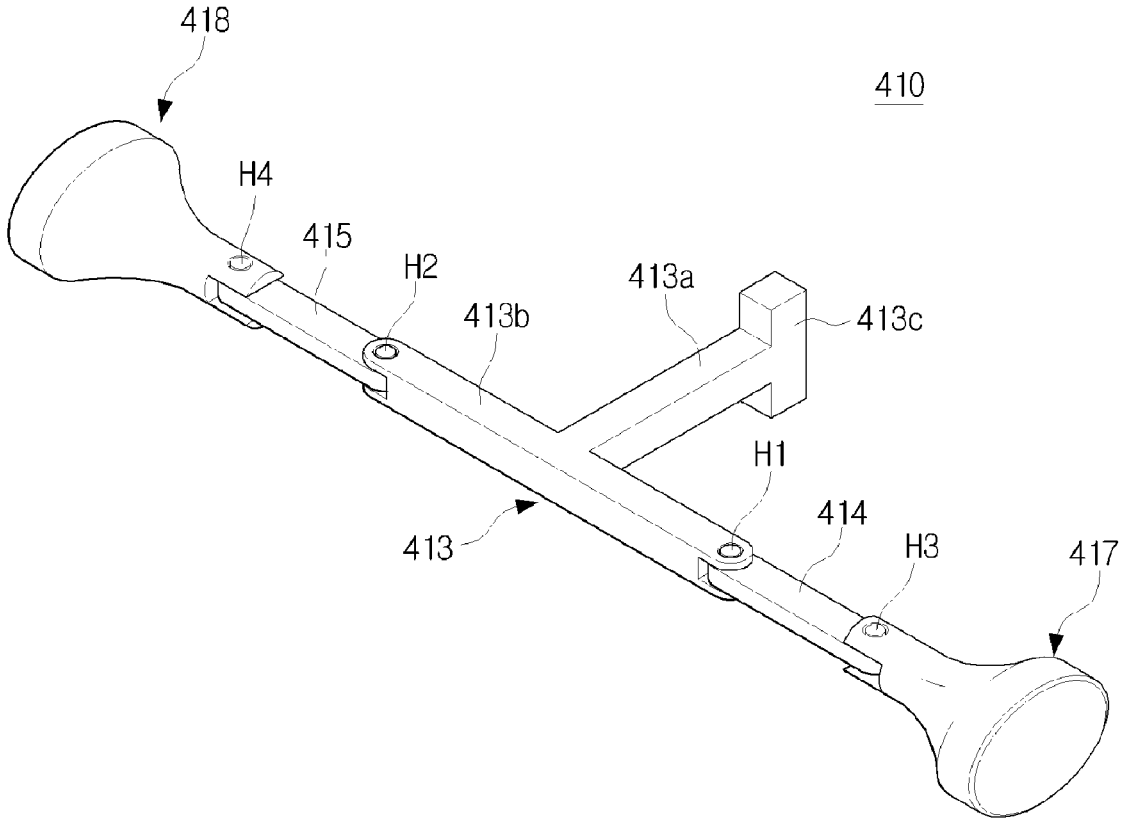
FIG. 10 is a perspective view illustrating an inactive mode of an actuating portion according to another exemplary embodiment of the present invention.

While the above exemplary embodiment of the present invention discloses that the actuating portion 310 includes the lever 311, the operating frame 313, the pair of link bars 314, 315, and the pair of knobs 317, 318, it may also be possible to configure the actuating portion 310 without the lever 311. Referring to FIG. 10, an actuating portion 410 has a structure similar to the above-described actuating portion 310, but without a section corresponding to the lever 311. A first portion 413*a* of the operating frame 413 is disposed perpendicularly in the same plane to a second portion 413*b*. A part 413*c* of the first portion 413*a* protrudes towards the rear portion of the cleaner body 100 so that a user may conveniently hold the operating frame 413.

When the height adjusting apparatus 300 of the actuating portion 410 is set in an inactive mode, the second portion 413*b* of the operating frame 413, a pair of link bars 414, 415, and a pair of knobs 417, 418 are aligned, as shown in FIG. 10. When the user pulls the portion 413*c* of the operating frame 413 toward the rear portion of the cleaner body 100 to change the height adjusting apparatus 300 from the inactive mode to the active mode, the operating frame 413 pulls the pair of link bars 414, 415 while being drawn horizontally back. The pair of knobs 417, 418 move horizontally toward the center of the cleaner body 100, and thus the pair of knobs 417, 418 are placed at the first position.

Figure 11:
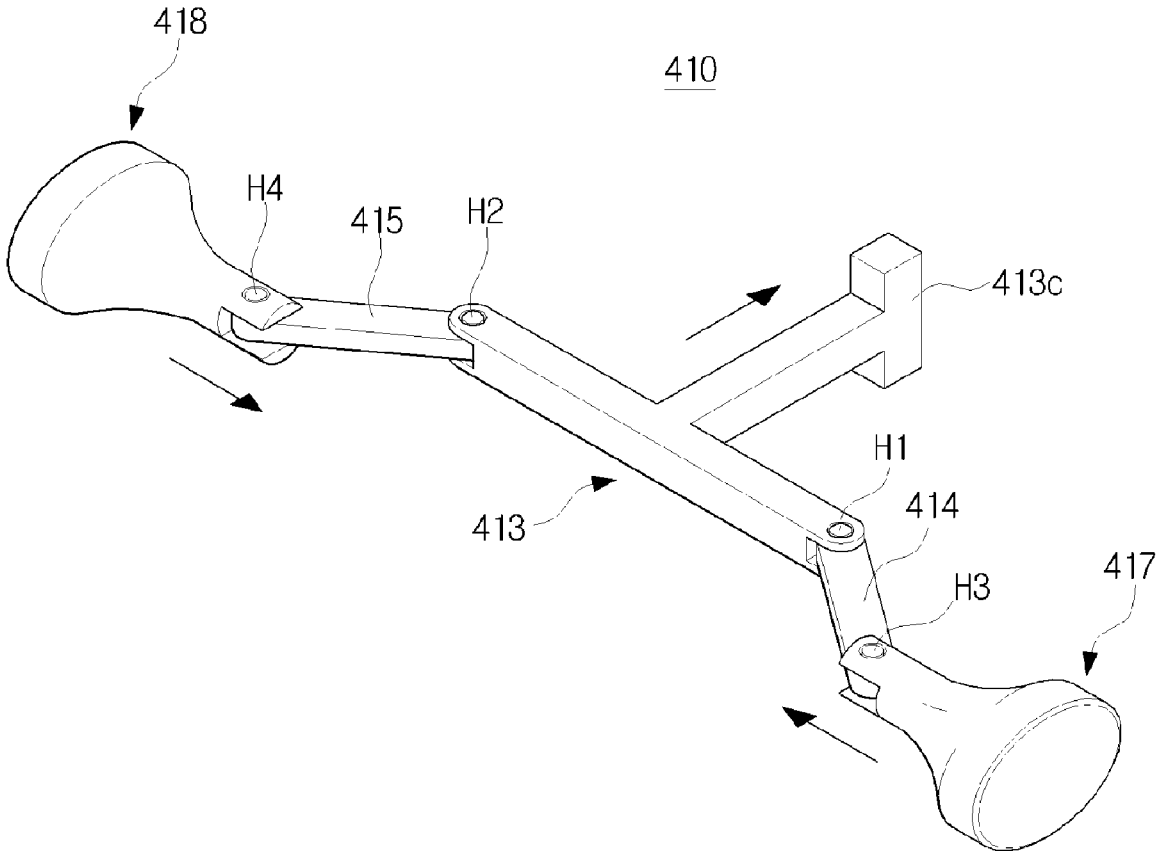
FIG. 11 is a perspective view illustrating the actuating portion of FIG. 10 set to an active mode.

The operation when employing the actuating portion is the same as the above operations, and thus detailed description will be omitted. Points H1, H2, H3, and H4 shown in FIGS. 10 and 11 represent hinge points.

According to the exemplary embodiments of the present invention, the cleaner body is in an upright position or is tilted, causing the height adjusting apparatus of the suction port assembly to be in an active mode or an inactive mode. Therefore, a user selectively determines that the drum brush is in contact with or removed from the surface according to the type of a surface being cleaned, so user convenience is enhanced.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An upright vacuum cleaner, comprising:

a cleaner body;

a suction port assembly hinged to the cleaner body, and including a drum brush rotatably mounted on a front lower surface thereof, and a pair of main wheels, wherein at least one main wheel is disposed on each side of a rear portion of the suction port assembly; and;

a height adjusting apparatus configured to be in an active mode or an inactive mode and including:

an actuating portion partially disposed in the cleaner body; and a pair of supporters each having one end that supports the actuating portion and another end connected to a shaft of one of the main wheels of the suction port assembly;

the actuating portion including a pair of knobs extending from within the cleaner body into the suction port assembly and each knob slidably coupled to one of the pair of supporters, respectively, wherein in the active mode, the knobs are set to a first position in which ends of the knobs are aligned with the supporters such that the height adjusting apparatus raises the rear portion of the suction port assembly from an initial height, in which the drum brush is spaced from a surface being cleaned, to bring the drum brush into contact with the surface when the cleaner body tilts from an upright position towards the rear of the suction port assembly, and the height adjusting apparatus lowers the rear portion of the suction port assembly to the initial height when the cleaner body returns to the upright position, and in the inactive mode, the knobs are set to a second position in which ends of the knobs extend past the supporters such that the rear portion of the suction port assembly remains at the initial height when the cleaner body tilts from the upright position towards the rear of the suction port assembly.

2. The upright vacuum cleaner of claim 1, wherein the actuating portion includes:

a lever hinged to the cleaner body, an operating frame, a pair of link bars, each being hinged to a respective end of the operating frame; and each of said knobs being hinged to a respective one of the link bars.

3. The upright vacuum cleaner of claim 1, wherein the actuating portion includes:

an operating frame, a pair of link bars, each being hinged to a respective end of the operating frame; and each of said knobs being hinged to a respective one of the link bars.

4. The upright vacuum cleaner of claim 2, wherein each knob includes:

a cylinder part; and a cam part which is formed on one end of the cylinder part.

5. The upright vacuum cleaner of claim 4, wherein the cam part is formed in an oval shape, the center of the cam part corresponds to the center of the cylinder part, and the length of a minor axis of the cam part is equal to the diameter of the cylinder part.

6. The upright vacuum cleaner of claim 2, wherein each knob includes:

a cylinder part; and a cam part which protrudes from a side of the periphery of the cylinder member to form a curve.

7. The upright vacuum cleaner of claim 3, wherein each knob includes:

a cylinder part; and a cam part which is formed on one end of the cylinder part.

8. The upright vacuum cleaner of claim 7, wherein the cam part is formed in an oval shape, the center of the cam part corresponds to the center of the cylinder part, and the length of a minor axis of the cam part is equal to the diameter of the cylinder part.

9. The upright vacuum cleaner of claim 3, wherein each knob includes:

a cylinder part; and a cam part which protrudes from a side of the periphery of the cylinder member to form a curve.

10. The upright vacuum cleaner of claim 3, wherein each supporter includes:

an idle roller on which each knob moves horizontally.

11. The upright vacuum cleaner of claim 1, wherein the suction port assembly includes:

a partition wall which is connected to the shafts of the pair of main wheels.

* * * * *